US005922427A

United States Patent [19]

King

[11] Patent Number: 5,922,427

[45] Date of Patent: Jul. 13, 1999

[54] DISPOSABLE CLEANING DEVICE FOR CLEANING PARTICULATE MATTER

[75] Inventor: Russell M. King, 201-1450 Laburnum Street, Vancouver, British Columbia, V6J 3W3, Canada

[73] Assignee: Russell M. King, Vancouver, Canada

[21] Appl. No.: 08/927,107

[22] Filed: Aug. 29, 1997

[51] Int. Cl.[6] ..... B32B 7/06; B32B 7/12

[52] U.S. Cl. ..... 428/40.1; 428/136; 15/104.002; 206/447; 206/449

[58] Field of Search ..... 428/40.1, 136; 15/104.002; 206/447, 449

[56] References Cited

U.S. PATENT DOCUMENTS

| | | | |
|---|---|---|---|
| 2,724,847 | 11/1955 | Krasno | 15/104 A |
| 3,082,453 | 3/1963 | Mutchler et al. | 15/104.002 |
| 3,906,578 | 9/1975 | Huber | 15/104 A |
| 4,713,274 | 12/1987 | Minor | 428/40 |
| 4,820,558 | 4/1989 | Sundberg | 428/40 |

*Primary Examiner*—Alexander Thomas

[57] ABSTRACT

A device for cleaning loose particulate matter from a surface to which such matter is attached which includes a protective cover made of printable material and having a central pad receiving area and a protective flap on at least one side of the pad receiving area, foldable about the pad to enclose same. A pad of adhesive backed leaves with adhesive on an underlying surface of each of the leaves is attached to the protective cover in the bin receiving area.

7 Claims, 2 Drawing Sheets

DISPOSABLE CLEANING DEVICE FOR CLEANING PARTICULATE MATTER

FIELD

The present invention relates to a portable, disposable cleaning device suitable for removing particulate matter from various materials and especially clothing.

BACKGROUND OF THE INVENTION

There have been various approaches to removing particulate matter such as lint, dandruff, string, hair, etc., from clothing. Starting from the one-way velvet brushes which are drawn over the clothing in a single direction, to adhesive roller products that are rolled over clothing. Both of these items are large and sometimes considered too bulky to use when travelling.

Later inventions include a pad of adhesive sheets and attached protective covers as disclosed in U.S. Pat. No. 4,713,274 issued to Minor. Each sheet and attached protective cover may be removed from the pad and then the protective cover separated from the sheet so that the latter can be gripped by a human hand and used to remove the particulate matter on clothing. Separating a backing sheet or protective cover from each adhesive sheet after separating the adhesive sheet from the pad prior to use involves a two step process which is somewhat impractical.

U.S. Pat. No. 4,820,558 issued to Sundberg discloses a plastic mitt with adhesive on one outside surface and a protective cover over the adhesive. Once the protective cover sheet is removed, the mitt is used to press against clothing and remove lint and other particulate matter. It is questionable whether a plastic mitt the size of a person's hand is compact, but the main problem with this invention is that, like a single sheet from the pad of adhesive sheets, once the protective covering is removed one must use the mitt and then throw it away. The mitts require the placement of two plastic sheets together, a fusing of three edges, coating one of the outer surfaces with adhesive and then fabrication of the backing sheet and placement of the latter over the adhesive. Such a multi-step process is relatively expensive. Moreover, the mitt is really only available for use in certain fixed locations where it may be stored since it is too large to be conveniently carried by the user.

U.S. Pat. No. 3,906,578 issued to Huber discloses a lint remover pad containing an adhesive surface with projections which also have adhesive surfaces and a protective cover sheet to cover the adhesive surface of the pad. Again the single sheet must be manipulated by hand over the cloth being cleaned and afterward discarded. The projections are designed to assist cleaning between hard to reach areas. The fabrication of the projections is a separate fabrication step that is not required in most cases where the cloth is smooth. Moreover the adhesive on the end of the projections is not covered by the cover sheet and presents a problem for portable carriage.

U.S. Pat. No. 2,724,847 issued to Krasno discloses a lint removing device consisting of a plastic sheet with a pad of adhesive backed sheets. The plastic sheet folds over and encloses the pad of sheets. Krasno's pad of adhesive backed sheets have the adhesive facing outwardly and would tend to stick to the plastic flaps when closed, particularly when compressed inside a pocket or billfold making it awkward to open the flaps.

Accordingly, it is an object of the invention to provide an improved lint remover that is both cost efficient and capable of providing a format for more effective advertising. It is a further object of the invention to provide a lint remover that can be used as a business card.

SUMMARY OF THE INVENTION

According to the invention there is provided a device for cleaning loose particulate matter from a surface to which such matter is attached which includes protective cover made of printable material and having a central pad receiving area and a protective flap on at least one side of the pad receiving area, foldable about the pad to enclose same. A pad of adhesive backed leaves with adhesive on an underlying surface of each of the leaves is attached to the protective cover in the bin receiving area.

Preferably, two protective flaps are provided, one on each side of the central pad receiving area, and a cut line formed in one of the flaps is dimensioned to receive the other of the flaps so as to lock the protective cover and enclose the pad.

The dimensions of said device may be substantially the same as those of a business card.

An advertising message may be printed on the protective cover so that it is visible by a user.

In another aspect of the invention there is provided a method of making a disposable cleaning device for cleaning loose particulate matter from a surface to which such matter is attached. The method includes printing on printable sheet material desired advertising messages by means of any printing system that prints on a standard paper size such as a computer printer, a printing press, or laser copier. Next the printed sheets are die cut to a desired shape from the printable sheet material so as to form a protective cover for the cleaning device with a central pad receiving area and a pair of protective flaps on either side thereof, and affixing a pad of adhesive backed leaves to the bin receiving area.

The die cutting step may include dimensioning the protective cover to be of substantially the same dimensions when in a closed position as those of a business card.

The printable material may be a card stock.

The device is compact, flexible and disposable and can be used as a business card. The protective flaps fold over top of the pad to protect the top sheet thereof prior to use. By using ordinary card stock advertising messages may be placed on the device by using any means of printing on printable sheets of standard paper size such as an ordinary computer printer, making it possible to produce limited volumes without a significant cost penalty.

The combination is compact, sufficiently thin and low cost to be used in a promotional manner as a business card and also to carry multiple advertising messages. It can be dispensed as part of a hotel room package together with shampoo and other toiletries or it can be purchased by a traveller or a consumer at a low cost. It can also be given away as a complimentary promotional token by retail establishments, airlines, cruise ships and the like. By making its cover of ordinary card stock it can be fabricated using any printing means that prints on sheet material of a standard paper size such as an ordinary computer printer to produce flexible volumes at an extremely low cost.

BRIEF DESCRIPTION OF THE DRAWINGS

The invention may be best understood by reference to the detailed description which follows, in conjunction with the accompanying drawings, wherein.

LEGEND OF REFERENCE NUMBERS

10-device
12-protective cover
13-protective flap
14-protective flap
16-flap tip
18-cut line
19-fold line
20-fold line
22-fold line
24-pad receiving area
26-sloped edges
28-flap tip
30-sloped edges
32-pad of adhesive backed leaves
34-adhesive backed surface

DETAILED DESCRIPTION OF THE INVENTION

Figure 1:
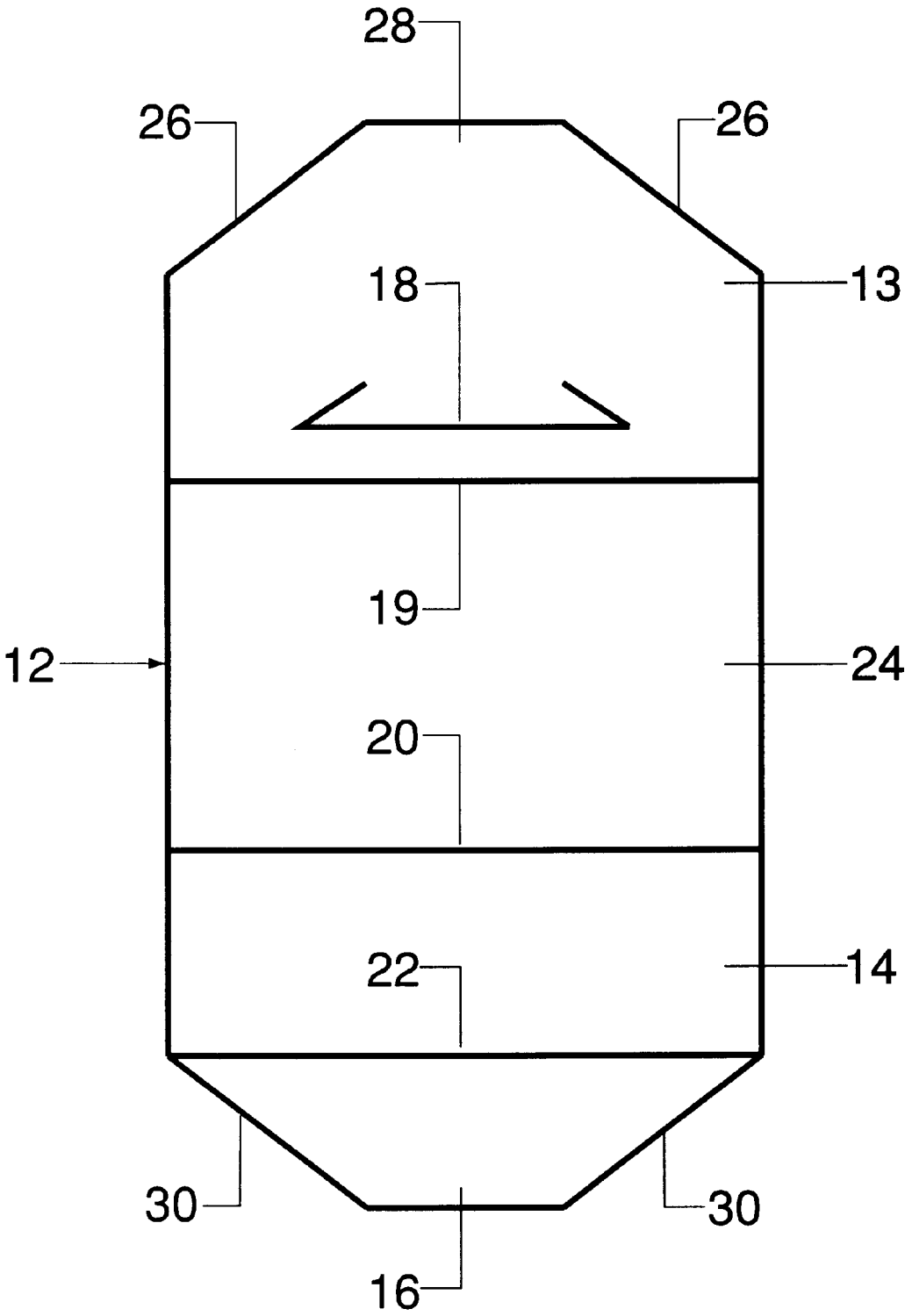
FIG. 1 is an inside view of the protective cover of the cleaning device with its protective flaps open.
Figure 2:
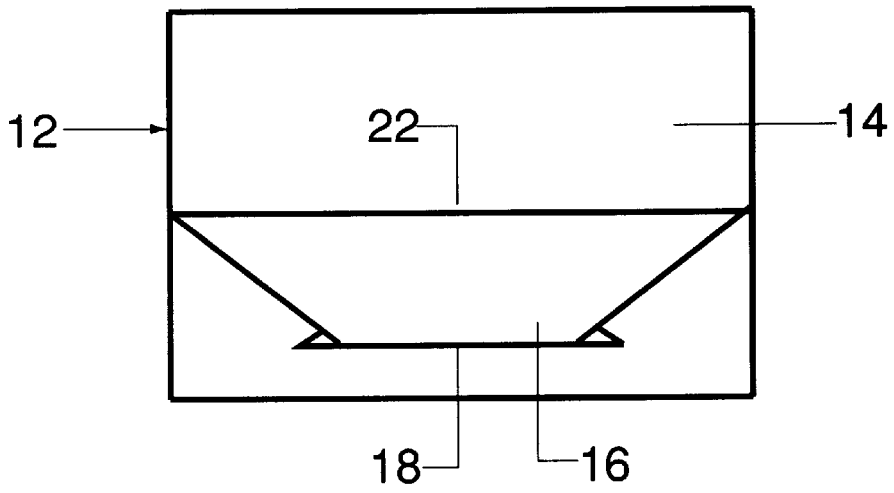
FIG. 2 is a front view of the cleaning device with the protective cover closed.
Figure 3:
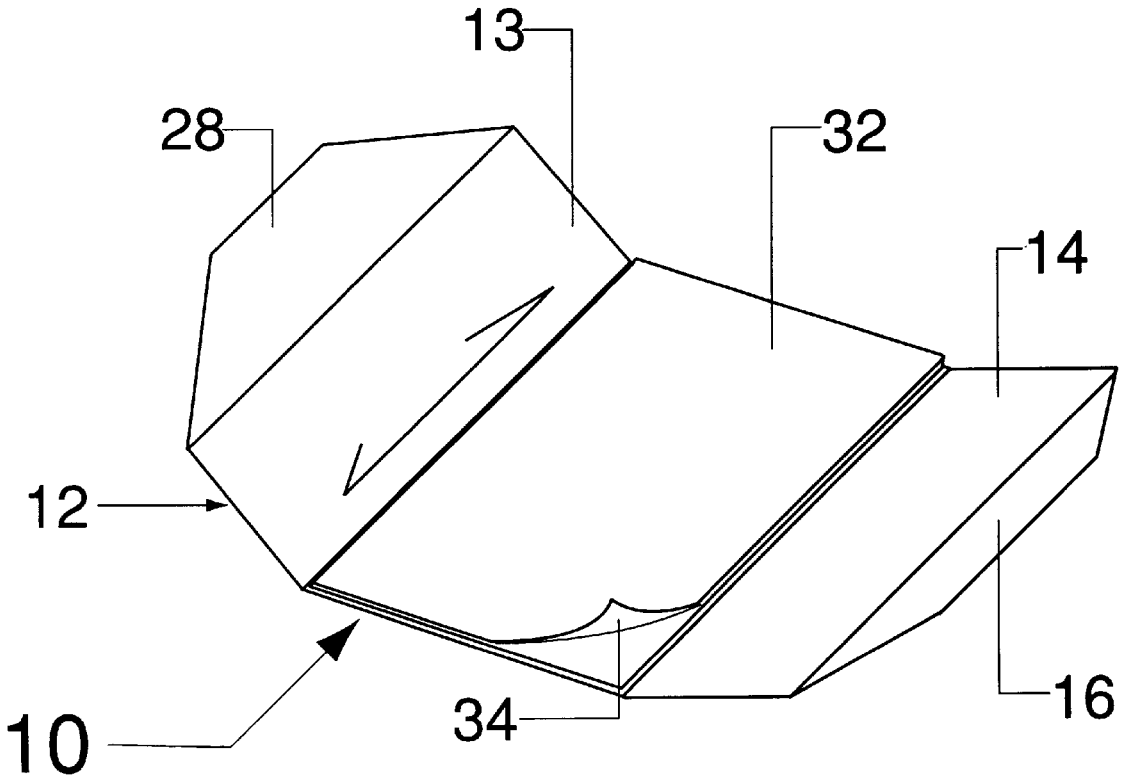
FIG. 3 is a perspective of the cleaning device with the protective cover open, exposing the fold line and showing the pad of adhesive backed leaves.

Referring now to FIGS. 1 to 3, the protective cover 12 of the device 10 is generally rectangular having two protective flaps 13 and 14 with sloped edges 26 and 30 at opposite ends of the long dimension. The protective flaps 13 and 14 fold about lines 19 and 20 and are separated by the latter lines from a pad receiving area 24. An additional fold line 22 in the protective flap 14 allows the flap tip 16 to be bent relative to the remainder of the protective flap 14. A cut line 18 is formed in flap 13 to receive flap tip 16 when protective flaps 13 and 14 are folded about fold lines 19, 20 and 22. A pad of adhesive backed leaves 32 is attached to pad receiving area 24. The pad 32 has adhesive on a back surface 34 of each leaf of the pad 32 and occupies the full area of the back surface 34.

The protective cover 12 is made of ordinary card stock which can be printed on using an ordinary laser printer, laser copier or printing press prior to being cut or stamped out. Consequently, the use of such material permits any message with a large number of fonts and font sizes as well as graphics and combinations of graphics, fonts and font sizes to be used and any number of cards to be made without suffering any financial penalty as would be the case in other printing processes.

Referring to FIG. 3 a pad of adhesive backed leaves 32 consists typically of 3–10 sheets of adhesive backed leaves that are pressed and held together front to back to form the pad 32. The pad 32 is affixed to the pad receiving area 24 by means of a suitable adhesive coating applied to surface 34 as shown in FIG. 3. The dimensions of pad 32 is approximately 2 ⅛" wide and 3-⅜" long, which makes them slightly smaller than the an average business card. When the sheets of pad 34 are pressed together during the manufacturing of the pad 34, the adhesive holds the individual sheets together. The adhesive also acts to adhere particulate matter to the sheet.

Many different materials can be used for the adhesive sheet material of this invention. Suitable materials include mylar, polyethylene, polypropylene, polystyrene and even paper products. The thickness of the card stock can vary as long as it is thin enough to fold.

The pressure sensitive adhesive used to remove particulate matter must be sticky enough to pick-up and hold particulate matter when the device is pressed against clothing. It also must not leave any residue on the clothing when the device is pulled away from the fabric. A third characteristic that is required of this adhesive is to hold each leaf of pad 34. Finally, the adhesive must bond sufficiently with the adhesive sheet material so as to remain on the front face of each adhesive sheet as a used sheet is separated from the pad 34. Moreover, the adhesive should not change its characteristics in a wide range of temperature and humidity conditions.

This device is a compact, inexpensive and practical one for removing particulate matter from materials, especially clothing. The flap tip 16 is withdrawn from cut line 18 and protective flaps 13 and 14 are opened up to expose the pad 32. An adhesive leaf is peeled off of the pad 32 and used to contact clothing or fabric with the adhesive surface thereof so as to cause unwanted particulates to adhere thereto. The cleaning procedure can then continue until the unwanted debris is removed.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A device for cleaning loose particulate matter from a surface to which such matter is attached, comprising:

(a) a protective cover made of printable material and having a central pad receiving area and a protective flap on at least one side of said central pad receiving area, said protective cover being foldable about said central pad receiving area to enclose said central pad receiving area; and (b) a pad of adhesive backed leaves comprising a plurality of leaves, each leaf having a non-adhesive upper surface and an undersurface, said undersurface having an adhesive area, said leaves being arranged into a stack of adjacent leaves such that the undersurface of each leaf removably adheres to the non-adhesive upper surface of an adjacent one of the leaves in said stack, and wherein said pad of adhesive backed leaves is attached to said protective cover in said central pad receiving area such that said pad of adhesive backed leaves is arranged with the adhesive portion of said leaves facing inwardly toward said central pad receiving area of said protective cover.

2. A device according to claim 1, including two protective flaps, one on each side of said central pad receiving area and a cut line on one of said flaps dimensioned to receive the other of said flaps to lock said protective cover so as to enclose said pad of adhesive backed leaves.

3. A device according to claim 2, wherein the adhesive area of each undersurface is sufficiently sticky so as to be able to remove particulate matter from fabric and does not leave residue thereon.

4. A device according to claim 3, wherein each adhesive area covers substantially all of a corresponding one of said undersurfaces.

5. A device according to claim 1, wherein the dimensions of said device are substantially the same as those of a business card.

6. A device according to claim 1, wherein the adhesive area of each undersurface is sufficiently sticky so as to be able to remove particulate matter from fabric and does not leave residue thereon.

7. A device according to claim 1, wherein each adhesive area covers substantially all of a corresponding one of said undersurfaces.

* * * * *